US010455941B2

(12) United States Patent
Zhu et al.

(10) Patent No.: US 10,455,941 B2
(45) Date of Patent: Oct. 29, 2019

(54) COLLAPSIBLE BUTTERFLY CHAIR

(71) Applicant: ZHEJIANG SUNSHINE LEISURE PRODUCTS CO., LTD., Jinhua, Zhejiang Province (CN)

(72) Inventors: Xiaohui Zhu, Jinhua (CN); Xuefeng Zheng, Jinhua (CN)

(73) Assignee: ZHEJIANG SUNSHINE LEISURE PRODUCTS CO., LTD., Jinhua, Zhejiang Province (CN)

( * ) Notice: Subject to any disclaimer, the term of this patent is extended or adjusted under 35 U.S.C. 154(b) by 0 days.

(21) Appl. No.: 16/011,208

(22) Filed: Jun. 18, 2018

(65) Prior Publication Data

US 2019/0298066 A1 Oct. 3, 2019

(30) Foreign Application Priority Data

Mar. 29, 2018 (CN) ..... 2018 2 0434372 U

(51) Int. Cl.
*A47C 4/28* (2006.01)
*A47C 4/30* (2006.01)

(52) U.S. Cl.
CPC ..... *A47C 4/286* (2013.01); *A47C 4/30* (2013.01)

(58) Field of Classification Search
CPC ..... A47C 4/286; A47C 4/30
USPC ..... 297/45, 42
See application file for complete search history.

(56) References Cited

U.S. PATENT DOCUMENTS 6,302,479 B1 * 10/2001 Zheng ..... A47C 4/286 297/16.2
6,634,705 B1 * 10/2003 Zheng ..... A47C 4/286 297/41
10,206,510 B2 * 2/2019 Choi ..... A47C 4/286
2016/0296022 A1 * 10/2016 Le ..... A47C 4/286

FOREIGN PATENT DOCUMENTS

CN 203987001 U 12/2014
CN 205306448 U 6/2016

* cited by examiner

*Primary Examiner* — Milton Nelson, Jr.
(74) *Attorney, Agent, or Firm* — Muncy, Geissler, Olds & Lowe, P.C.

(57) ABSTRACT

A collapsible butterfly chair comprises a support frame and a chair cover. The support frame comprises two first side support rods, two second side support rods, two front crossed rods hinged together in crossed mode, two rear crossed rods hinged together in a crossed mode, and two support rods. The first side support rods and the second side support rods are hinged together in a crossed mode and separately arranged on two opposite side vertical faces. Two sliding sleeves are slidably arranged on the two first side support rods in a sleeving mode separately. The lower ends of the support rods are hinged to the sliding sleeves. The upper ends of the support rods are hinged to the upper ends of the second side support rods.

10 Claims, 3 Drawing Sheets

COLLAPSIBLE BUTTERFLY CHAIR

BACKGROUND OF THE DISCLOSURE

Technical Field

The disclosure relates to the field of chairs, in particular to a collapsible butterfly chair.

Description of Related Art

Butterfly chairs have the advantages of being fashionable and attractive in appearance, collapsible, convenient to carry and the like, thereby popular with people. When having a trip, many families may carry a butterfly chair for enjoying the sunshine on the bench. The support frame of common butterfly chairs is generally composed of eight support rods with the ends connected through arc-shaped plastic parts, and the position of the unfolded support frame is limited through a cloth chair cover. However, on the one hand, since all the force applied to the battery chairs by people is borne by the chair cover, the chair cover bears a large tensile force, thereby being poor in durability; and on the other hand, the support frame of this structure is poor in stability and thus cannot stably stand after being folded.

Chinese utility model patent with Application No. 201420432593.4 (Publication No. CN203987001U) discloses an improved butterfly chair. The improved butterfly chair comprises four long rods and four short rods. Two short rods are hinged together in a crossed mode on the front vertical face. Two long rods are hinged together in a crossed mode on the rear vertical face. One short rod and one long rod are hinged together in a crossed mode on each of the two side vertical faces. The upper ends of the connected vertical face rods are hinged together, so that front fulcrums and rear fulcrums are formed; and the lower ends of the connected vertical face rods are also hinged together, so that four ground support points are formed. The butterfly chair disclosed by this utility model lacks the support function in the vertical direction, thereby being poor in bearing capacity; and sharp corners exist at the joints of the cloth cover and the four vertexes, and the cloth cover is prone to being torn in use, resulting in a short service life of the chair.

Chinese utility model patent with Application No. 201620056636.2 (Publication No. CN205306448U) discloses a butterfly chair. The support frame of the butterfly chair is mainly composed of eight support rods, and the position of the unfolded support frame is limited through the chair cover. Although the butterfly chair is provided with two back tubes, the back tubes can only limit the movement of the support frame in the horizontal direction, cannot limit the movement of the support frame in the vertical direction and thus do not have a support function, and the force applied by people to the butterfly chair in the vertical direction is converted into the tensile force to the chair cover. Thus, the butterfly chair disclosed by this utility model is poor in bearing capacity, and the chair cover is nondurable.

BRIEF SUMMARY OF THE DISCLOSURE

To solve the above-mentioned problems, the disclosure provides a collapsible butterfly chair, solving the problems of poor stability and bearing capacity of traditional butterfly chairs as well as poor durability of traditional chair covers.

To realize the above objective, the following technical scheme is adopted by the disclosure:

A collapsible butterfly chair comprises a support frame and a chair cover. The support frame comprises two first long side support rods, two second short side support rods, two front crossed rods hinged together in a crossed mode, two rear crossed rods hinged together in a crossed mode, and two support rods. The first side support rods and the second side support rods are hinged together in a crossed mode and separately arranged on two opposite side vertical faces. The lower ends of the two front crossed rods are separately hinged to the lower ends of the two first side support rods. The upper ends of the two front crossed rods are separately hinged to the upper ends of the two second side support rods. The lower ends of the two rear crossed rods are separately hinged to the lower ends of the two second side support rods. The upper ends of the two rear crossed rods are separately hinged to the two first side support rods. The support frame further comprises two sliding sleeves which are slidably arranged on the two first side support rods in a sleeving mode separately. The lower ends of the support rods are hinged to the sliding sleeves. The upper ends of the support rods are hinged to the upper ends of the second side support rods.

Furthermore, the lower ends of the first side support rods and the lower ends of the front crossed rods are hinged together through footpads, and the lower ends of the second side support rods and the lower ends of the rear crossed rods are hinged together through footpads. Each footpad comprises a support face located at the lower end and two perpendicular hinge parts located on the support face.

Furthermore, the support rods and the front crossed rods are hinged to the second side support rods through hinge components.

Furthermore, each hinge component comprises a sleeve part arranged on the corresponding second side support rod in a sleeving mode, a threaded lock hole formed in the sleeve part and used for locking the hinge component on the corresponding second side support rod, and a first hinge part and a second hinge part both connected with the sleeve part. The support rods are hinged to the first hinge parts, and the front crossed rods are hinged to the second hinge parts.

Furthermore, a first hinge face of each first hinge part is perpendicular to a second hinge face of the corresponding second hinge part.

Or, the front crossed rods are hinged to the second hinge parts of the hinge components through connecting pieces. Each connecting piece comprises a first connecting part and a second connecting part perpendicular to the first connecting part. A first hinge face of each first hinge part and a second hinge face of the corresponding second hinge part are in parallel and both parallel to the axial direction of the corresponding second side support rod. The front crossed rods are hinged to the first connecting parts. The second hinge parts of the hinge components are fixedly connected with the second connecting parts.

Furthermore, the first side support rods and the rear crossed rods are hinged together through hinge components.

Furthermore, the upper ends of the two rear crossed rods are separately hinged to positions, close to the upper ends, of the two first side support rods, and the portions, above the hinge positions, of the two first side support rods form a backrest support part.

Furthermore, the upper tail ends of the first side support rods and the upper tail ends of the second side support rods are fixedly sleeved with T-shaped support bases.

Furthermore, the edges of the T-shaped support bases are rounded.

By adoption of the above technical scheme, the disclosure has the following beneficial effects:

1. The support rods arranged on the front vertical face of the butterfly chair of the disclosure, so that the bearing capacity and stability of the butterfly chair are greatly improved.

2. The four footpads of the disclosure are independent force bearing points, so that the stability of the butterfly chair is greatly enhanced, and the butterfly chair can stably stand after being folded.

3. In the disclosure, the T-shaped support bases are fixedly connected to the top ends of the first side support rods and the top ends of the second side support rods, so that the contact area with the chair cover is enlarged, and the chair cover is protected based on the fact that under the same applied force condition, the larger the contact area, the smaller the pressure intensity.

DETAILED DESCRIPTION OF THE DISCLOSURE

Figure 1:
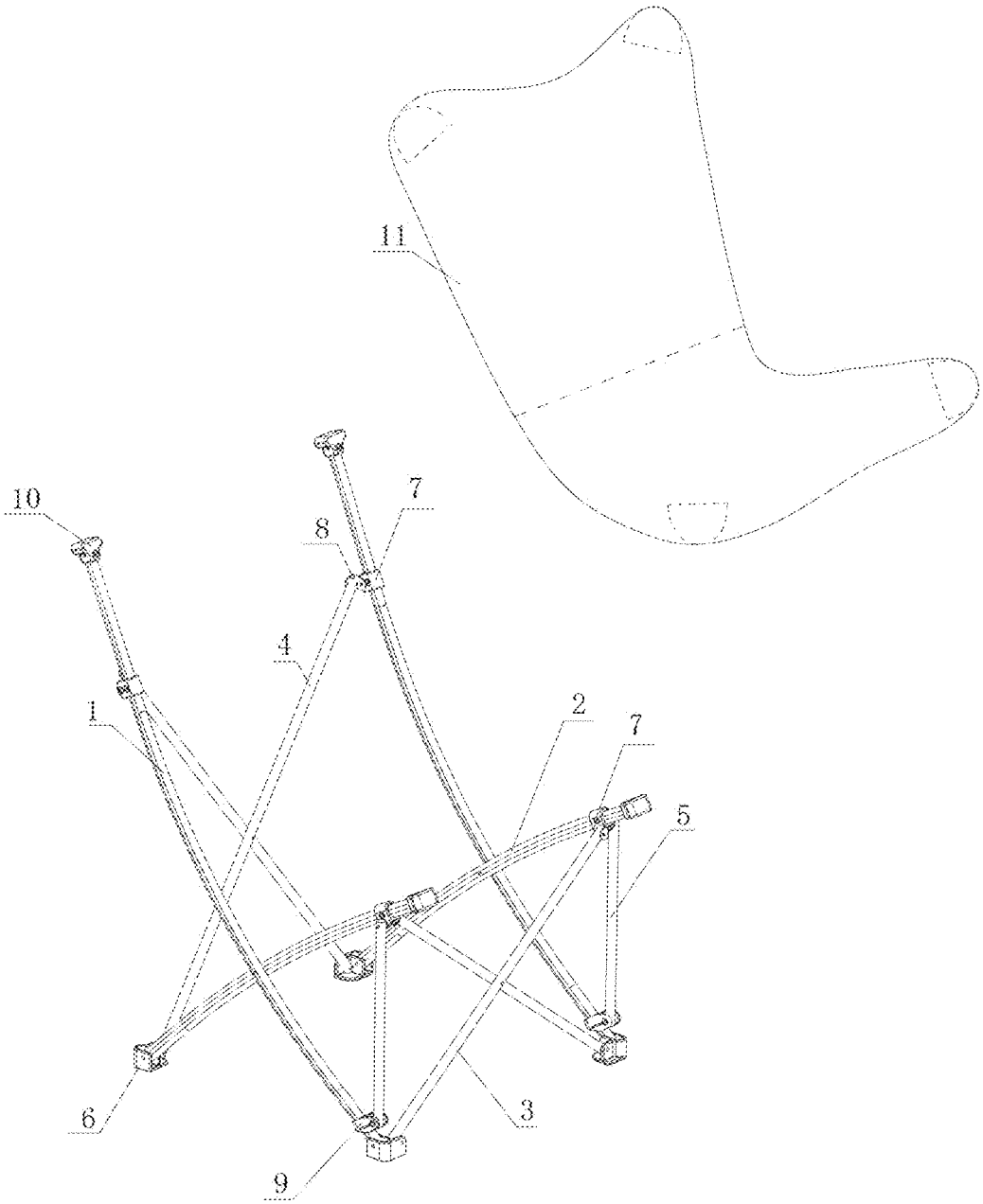
FIG. 1 is a structural view of the embodiment in an unfolded state of the disclosure.

For a further illustration of all embodiments, the drawings are provided by the disclosure. These drawings are part of the contents disclosed by the disclosure and mainly used for illustrating the embodiments and explaining the operation principle of the embodiments in cooperation with relevant description in the specification. By referring to these contents, those ordinarily skilled in the field would understand other possible execution modes and advantages of the disclosure. The components in the drawings are drawn not in scale, and similar component reference signs are generally representing similar components.

The disclosure is further described in combination with the drawings and the specific embodiment as follows.

Figure 2:
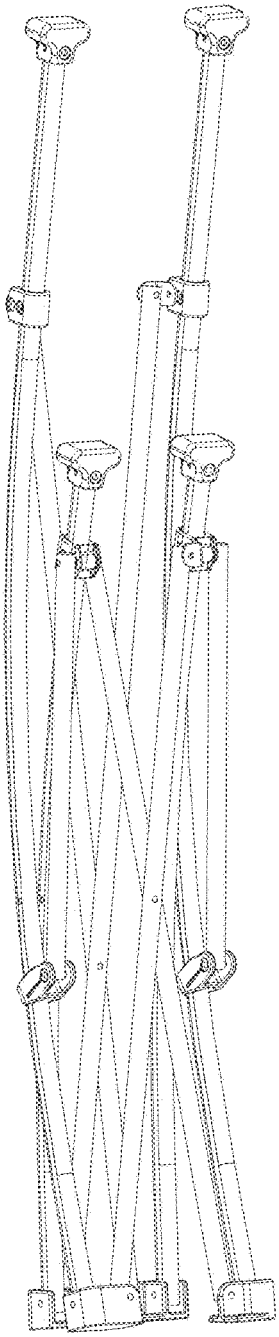
FIG. 2 is a structural view of the embodiment in a folded state of the disclosure.

As is shown in FIG. 1 and FIG. 2, the embodiment of the disclosure discloses a collapsible butterfly chair. The collapsible butterfly chair comprises a support frame and a chair cover 11. The support frame comprises two first long side support rods 1, two second short side support rods 2, two front crossed rods 3, two rear crossed rods 4 and two support rods 5.

In this embodiment, the plane close to the two shanks of a person sitting on the butterfly chair is defined as a front vertical face, the plane close to the back of the person sitting on the butterfly chair is defined as a rear vertical face, and the planes close to the two sides of the body of the person sitting on the butterfly chair are defined as side vertical faces.

The two front crossed rods 3 are hinged together in a crossed mode on the front vertical face. The two rear crossed rods 4 are hinged together in a crossed mode on the rear vertical face. The first side support rods 1 and the second side support rods 2 are hinged together in a crossed mode on the side vertical faces.

The lower ends of the two front crossed rods 3 are separately hinged to the lower ends of the two first side support rods 1. The upper ends of the two front crossed rods 3 are separately hinged to the upper ends of the two second side support rods 2. The lower ends of the two rear crossed rods 4 are separately hinged to the lower ends of the two second side support rods 2. The upper ends of the two rear crossed rods 4 are separately hinged to the two first side support rods 1. The support frame further comprises two sliding sleeves 9 slidably arranged on the two first side support rods 1 in a sleeving mode separately. The lower ends of the support rods 5 are hinged to the sliding sleeves 9. The upper ends of the support rods 5 are hinged to the upper ends of the second side support rods 2.

In this embodiment, the upper ends of the two rear crossed rods 4 are separately hinged to positions, close to the upper ends, of the two first side support rods 1. The portions, above the hinge positions, of the two first side support rods 1 form a backrest support part.

The lower ends of the first side support rods 1 and the lower ends of the front crossed rods 3 are hinged together through food pads 6, and the lower ends of the second side support rods 2 and the lower ends of the rear crossed rods 4 are hinged together through footpads 6. Each footpad 6 comprises a support face located at the lower end and two perpendicular hinge parts located on the support face.

Figure 3:
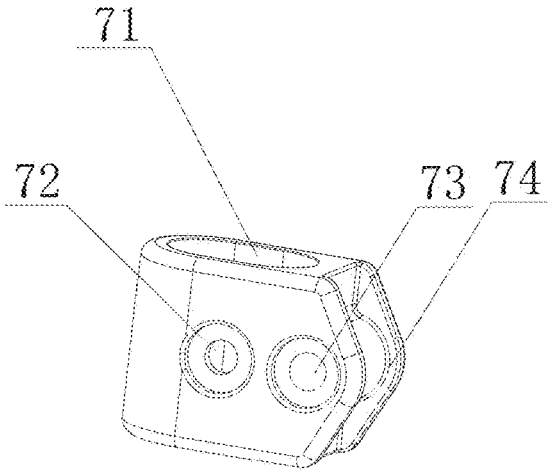
FIG. 3 is a structural view of a hinge component in the embodiment of the disclosure.

The support rods 5 and the front crossed rods 3 are hinged to the second side support rods 2 through hinge components 7. As is shown in FIG. 3, each hinge component 7 comprises a sleeve part 71 arranged on the corresponding second side support rod 2 in a sleeving mode, a threaded lock hole 72 formed in the sleeve part and used for locking the hinge component 7 on the corresponding second side support rod 2, and a first hinge part 73 and a second hinge part 74 both connected with the sleeve part. The support rods 5 are hinged to the first hinge parts 73, and the front crossed rods 3 are hinged to the second hinge parts 74. Since the hinge faces between the support rods 5 and the second side support rods 2 are perpendicular to the hinge faces between the front crossed rods 3 and the second side support rods 2, each hinge component may comprise a first hinge part provided with a first hinge face and a second hinge part provided with a second hinge face perpendicular to the first hinge face. Or, in this embodiment, the front crossed rods 3 are hinged to the second hinge parts 74 of the hinge components 7 through connecting pieces 8. Each connecting piece 8 comprises a first connecting part and a second connecting part perpendicular to the first connecting part. A first hinge face of each first hinge part 73 and a second hinge face of the corresponding second hinge part are in parallel and both parallel to the axial direction of the corresponding second side support rod 2. The front crossed rods 3 are hinged to the first connecting parts. The second hinge parts 74 of the hinge components 7 are fixedly connected with the second connecting parts.

The first side support rods 1 and the rear crossed rods 4 are hinged together through hinge components 7. In this embodiment, the rear crossed rods 4 are hinged to the hinge components 7 fixedly arranged on the first side support rods 1 through connecting pieces 8.

Figure 4:
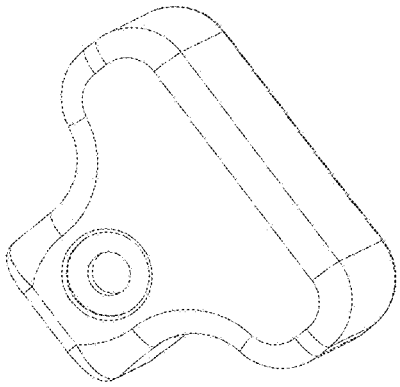
FIG. 4 is a structural view of a T-shaped support base in the embodiment of the disclosure.

Based on the fact that under the same applied force condition, the larger the contact area, the smaller the pressure intensity, in this embodiment, T-shaped support bases 10 shown in FIG. 4 are preferably fixedly arranged at the ends, away from the ground, of the first side support rods 1 and the second side support rods 2 to enlarge the contact area between the support frame and the chair cover 11, which may otherwise cause damage to the chair cover 11 due to an excessively small contact area. In order to achieve convenient installation, the T-shaped support bases 10 are fixedly arranged on the first side support rods 1 and the second side support rods 2 through bolts, in this embodiment. In order to prevent the chair cover 11 from being worn when the T-shaped support bases 10 are connected to the chair cover 11, the edges of the T-shaped support bases 10 are preferably rounded, in this embodiment.

In this embodiment, the support rods 5 limit the positions of the first side support rods 1 and the second side support rods 2 and also limit the positions of the two front crossed rods 3 after the support frame is unfolded, and thus after being unfolded, the support frame can stably stand without being limited by the chair cover 11. As the main force borne by the butterfly chair, the pressure applied to the butterfly chair in the vertical direction is borne by the vertically arranged support rods 5, so that the bearing capacity and stability of the butterfly chair are greatly improved. Since the front portion of the butterfly chair bears most gravity, the support rods 5 are arranged on the front vertical face, in this embodiment.

Although the disclosure is specifically illustrated and described with the preferred embodiment, those skilled in the field wound appreciate that various transformations of the disclosure made in form and in detail without deviating from the spirit and scope defined by the claims of the disclosure should fall within the protection scope of the disclosure.

What is claimed is:

1. A collapsible butterfly chair, comprising a support frame and a chair cover, characterized in that the support frame comprises two first long side support rods, two second short side support rods, two front crossed rods hinged together in a crossed mode, two rear crossed rods hinged together in a crossed mode, and two support rods; the first side support rods and the second side support rods are hinged together in a crossed mode and separately arranged on two opposite side vertical faces, lower ends of the two front crossed rods are separately hinged to lower ends of the two first side support rods, upper ends of the two front crossed rods are separately hinged to upper ends of the two second side support rods, lower ends of the two rear crossed rods are separately hinged to lower ends of the two second side support rods, and upper ends of the two rear crossed rods are separately hinged to the two first side support rods; and the collapsible butterfly chair further comprises two sliding sleeves which are slidably arranged on the two first side support rods in a sleeving mode separately, lower ends of the support rods are hinged to the sliding sleeves, and upper ends of the support rods are hinged to the upper ends of the second side support rods.

2. The collapsible butterfly chair according to claim 1, wherein the lower ends of the first side support rods and the lower ends of the front crossed rods are hinged together through footpads, the lower ends of the second side support rods and the lower ends of the rear crossed rods are hinged together through footpads, and each said footpad comprises a support face located at a lower end and two perpendicular hinge parts located on the support face.

3. The collapsible butterfly chair according to claim 1, wherein the support rods and the front crossed rods are hinged to the second side support rods through hinge components.

4. The collapsible butterfly chair according to claim 3, wherein each said hinge component comprises a sleeve part arranged on the corresponding second side support rod in a sleeving mode, a threaded lock hole formed in the sleeve part and used for locking the hinge component on the corresponding second side support rod, and a first hinge part and a second hinge part both connected with the sleeve part; and the support rods are hinged to the first hinge parts, and the front crossed rods are hinged to the second hinge parts.

5. The collapsible butterfly chair according to claim 4, wherein a first hinge face of each said first hinge part is perpendicular to a second hinge face of the corresponding second hinge part.

6. The collapsible butterfly chair according to claim 4 , wherein the front crossed rods are hinged to the second hinge parts of the hinge components through connecting pieces, and each said connecting piece comprises a first connecting part and a second connecting part perpendicular to the first connecting part; a first hinge face of each said first hinge part and a second hinge face of the corresponding second hinge part are in parallel and both parallel to an axial direction of the corresponding second side support rod; and the front crossed rods are hinged to the first connecting parts, and the second hinge parts of the hinge components are fixedly connected with the second connecting parts.

7. The collapsible butterfly chair according to claim 3, wherein the first side support rods and the rear crossed rods are hinged together through hinge components.

8. The collapsible butterfly chair according to claim 1, wherein the upper ends of the two rear crossed rods are separately hinged to positions, close to upper ends, of the two first side support rods, and portions, above the hinge positions, of the two first side support rods form a backrest support part.

9. The collapsible butterfly chair according to claim 1, wherein upper tail ends of the first side support rods and upper tail ends of the second side support rods are fixedly sleeved with T-shaped support bases.

10. The collapsible butterfly chair according to claim 9, wherein edges of the T-shaped support bases are rounded.

* * * * *